United States Patent [19]

Erdmann et al.

[11] 4,052,595

[45] Oct. 4, 1977

[54] AUTOMATIC VEHICLE MONITORING SYSTEM

[75] Inventors: David P. Erdmann, Hopkins; Dennis L. Kurschner, Minnetonka, both of Minn.

[73] Assignee: Honeywell Inc., Minneapolis, Minn.

[21] Appl. No.: 697,610

[22] Filed: June 18, 1976

[51] Int. Cl.[2] ..... G08G 1/065

[52] U.S. Cl. ..... 235/92 TC; 235/92 EV; 235/92 R; 340/38 L

[58] Field of Search ..... 235/92 TC, 92 PK, 92 EV, 235/92 PB, 98 A; 340/38 L; 324/41

[56] References Cited

U.S. PATENT DOCUMENTS

| | | | |
|---|---|---|---|
| 3,126,522 | 3/1964 | Fieser | 235/92 TC |
| 3,374,340 | 3/1968 | Auer et al. | 235/92 TC |
| 3,644,825 | 2/1972 | Davis et al. | 340/38 L |
| 3,745,450 | 7/1973 | Wilt | 340/38 L |

*Primary Examiner*—Joseph M. Thesz
*Attorney, Agent, or Firm*—Albin Medved

[57] ABSTRACT

A vehicle monitoring system for detecting the passage of vehicles past a predetermined point along a road. Using a pair of magnetic sensors positioned in a spaced relationship, together with appropriate logic circuitry, the apparatus according to the present invention is able to detect the number of and the direction of vehicles traveling along said road. Counting means are also provided to give an indication of the number of vehicles passing in each of the two directions during any selected period of time.

8 Claims, 9 Drawing Figures

FIG. 6
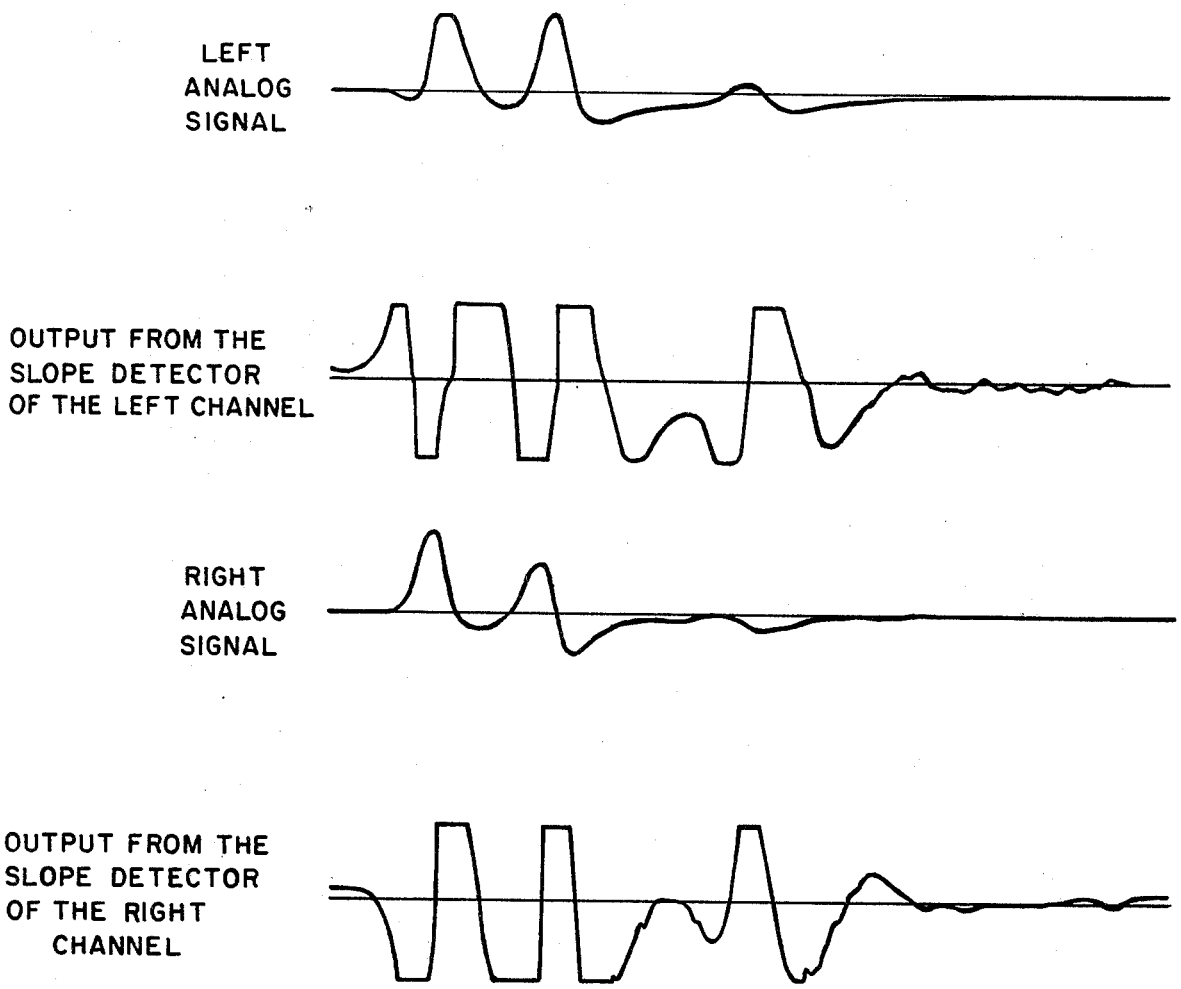
FIG. 7A
FIG. 7B
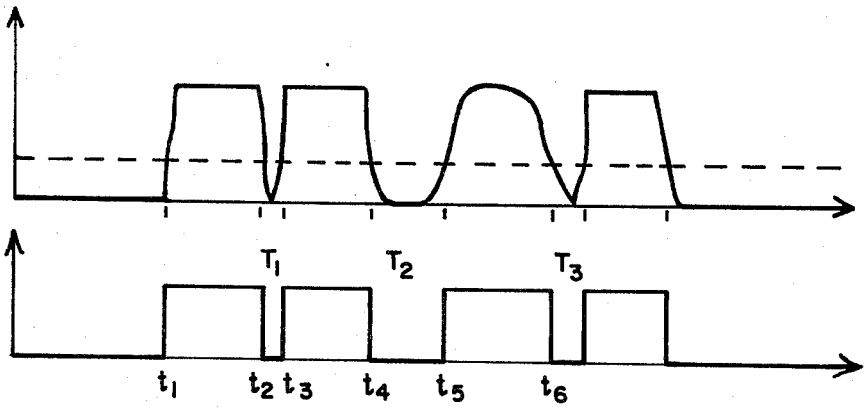

AUTOMATIC VEHICLE MONITORING SYSTEM

BACKGROUND OF THE INVENTION

1. Field of the Invention

The present invention relates to magnetic sensors for detecting the movement of vehicles along a predetermined path. In particular, the apparatus according to the present invention detects magnetic field perturbations caused by moving objects containing ferrous or other magnetically permeable material. The magnetic sensors consist of multi-turn coils of wire wound on magnetically permeable core material. Analog and digital processing apparatus associated with the sensors extract from the sensor signal the information relative to the number and the direction of vehicle movements.

SUMMARY OF THE INVENTION

A pair of magnetic transducers are positioned in a spaced relationship along the road or pathway where vehicle movement is to be monitored. The input signals are generated by magnetic field perturbations in the vicinity of each transducer. These perturbations are caused by moving objects containing ferrous or other magnetically permeable material. The characteristics of the perturbation are a function of earth's ambient magnetic field strength, the geometry, speed, closest point of approach, and material composition of the moving object, and the relative orientation of the transducers, the direction of the path of the moving object, and the earth's field vector. The function of the automatic vehicle monitoring system according to the present invention is to sense the direction and density of vehicle travel along the roadway. It is intended for use primarily in areas of low density travel, especially in remote locations where automatic detection of both vehicle direction of travel and the number of vehicles is desired.

An analog signal preprocessor is provided having two identical channels. The two signals from the magnetic transducers are applied to the inputs of the two channels. An input network is provided in each channel to give a degree of protection from large transducer signals and to provide a first order rejection of high frequency interferring signals. The signal from the input network is amplified in a high gain amplifier to increase the signal to a more useable level and then passed through a low pass filter where higher frequencies are eliminated and a 6db/oct roll-off is produced across the useable pass band to thereby generate an output signal which is directly proportional to the magnetic field disturbance. The signal is then again amplified in a high gain amplifier to further increase it to the desirable level. The signal from the second high gain amplifier is passed through a slope detector which is capable of producing a bi-polar output signal in response to a minor disturbance in a uni-polar input signal. From the output of the slope detector, the signal is applied to positive and negative threshold detectors which generate digital output whenever the input signal exceeds a preset threshold.

The signals from the threshold detectors and the slope detector are operated upon in a digital signal processing circuit to extract information concerning the number and the direction of vehicle travel along the path. The logic circuitry is enabled when simultaneous positive or negative threshold signals are generated from each of the two channels. A pair of zero-crossing detectors receive signals from the slope detectors and provide output signals whenever zero crossings occur. At the time of the simultaneous threshold occurrences, an event latch circuit is enabled and is ready to be set by the first of the zero-crossing signals from the two zero-crossing detectors. The output of these latches determines the direction of the vehicle causing that disturbance. Reliance on first signal zero-crossing in the manner described herein, rather than on the first signal to exceed a predetermined threshold, as the indication of the direction of the vehicle travel, increases reliability of the logic signal processing and essentially eliminates the dependence on the orientation of the sensors with respect to the direction of the earth's magnetic field.

The counting of the vehicles is accomplished by passing the signal from one of the slope detectors through a full wave rectifier, passing it through a sampling "D" flip-flop to create a digital pulse train of varying pulse widths and counting the pulses provided at the output of the sampling "D" flip-flop in accordance with criteria discussed in more detail later in the specification in connection with the description of the preferred embodiment.

It is therefore an object of the present invention to provide a means for detecting the movement of a vehicle along a predetermined path and to determine the direction of said vehicle movement.

A further object of the present invention is to count the number of vehicles traveling in each of two directions along a path within a given period of time.

BRIEF DESCRIPTION OF THE DRAWINGS

A better understanding of the specific nature of the present invention, as well as other objects, advantages, and uses of the invention, will become apparent from the following detailed description with the accompanying drawings, in which:

FIG. 6 illustrates typical signals appearing at the inputs and the outputs of the slope detectors of FIG. 2 during presence of a disturbance caused by vehicles traveling along a path under surveillance;

FIG. 7A illustrates the input signal to threshold detector 51 of FIG. 3 and FIG. 7B illustrates an output thereof.

DESCRIPTION OF THE PREFERRED EMBODIMENT

Figure 1:
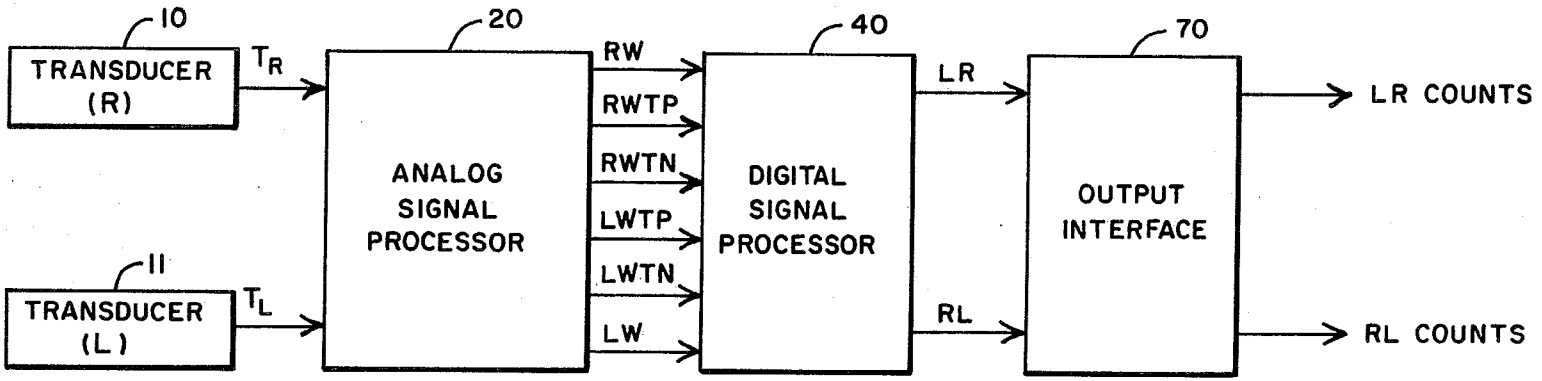
FIG. 1 is a general block diagram of an automatic vehicle monitoring system according to the present invention.

Referring to FIG. 1, a functional block diagram of the automatic vehicle monitoring system according to the present invention is shown consisting of two identical magnetic field transducers 10 and 11, a dual channel analog signal processor 20, a multiple input digital signal processor 40, and an output interface network 70.

Magnetic field transducers 10 and 11 each consist of a multi-turn coil of wire wound on a magnetically permeable core material. The transducers produce an output voltage $v(t)$ proportional to the time derivative input of magnetic field $h(t)$ according to the following equation:

$$V(t) = k(d/dt)\, h(t)$$

where $K$ is a constant dependent upon the number of turns, the coil area, and the effective magnetic permeability of the core structure. Transducers 10 and 11 are positioned relative to a vehicle path and to each other in such a way that they have maximum sensitivity to magnetic field disturbance at two separate locations along said path.

Figure 2:
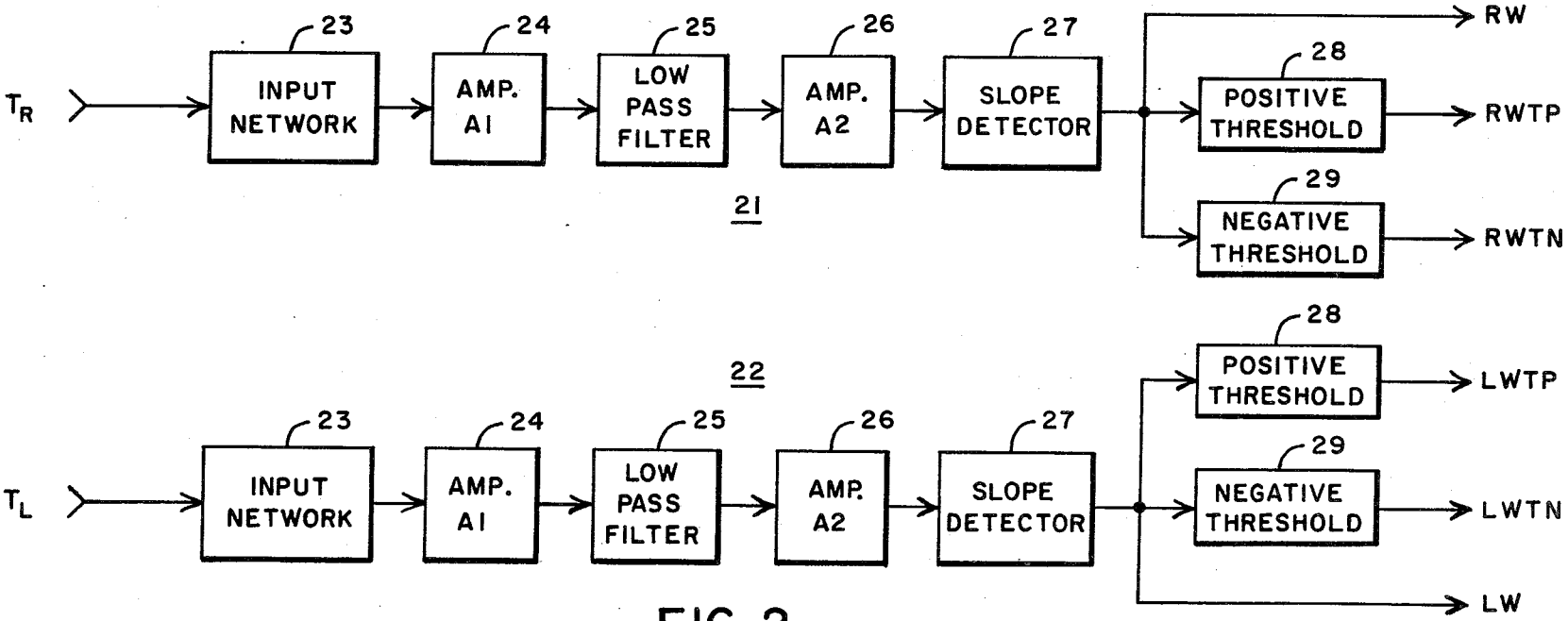
FIG. 2 is a block diagram of the analog signal processor used in the preferred embodiment of an automatic vehicle monitoring system as shown in FIG. 1.
Figure 4:
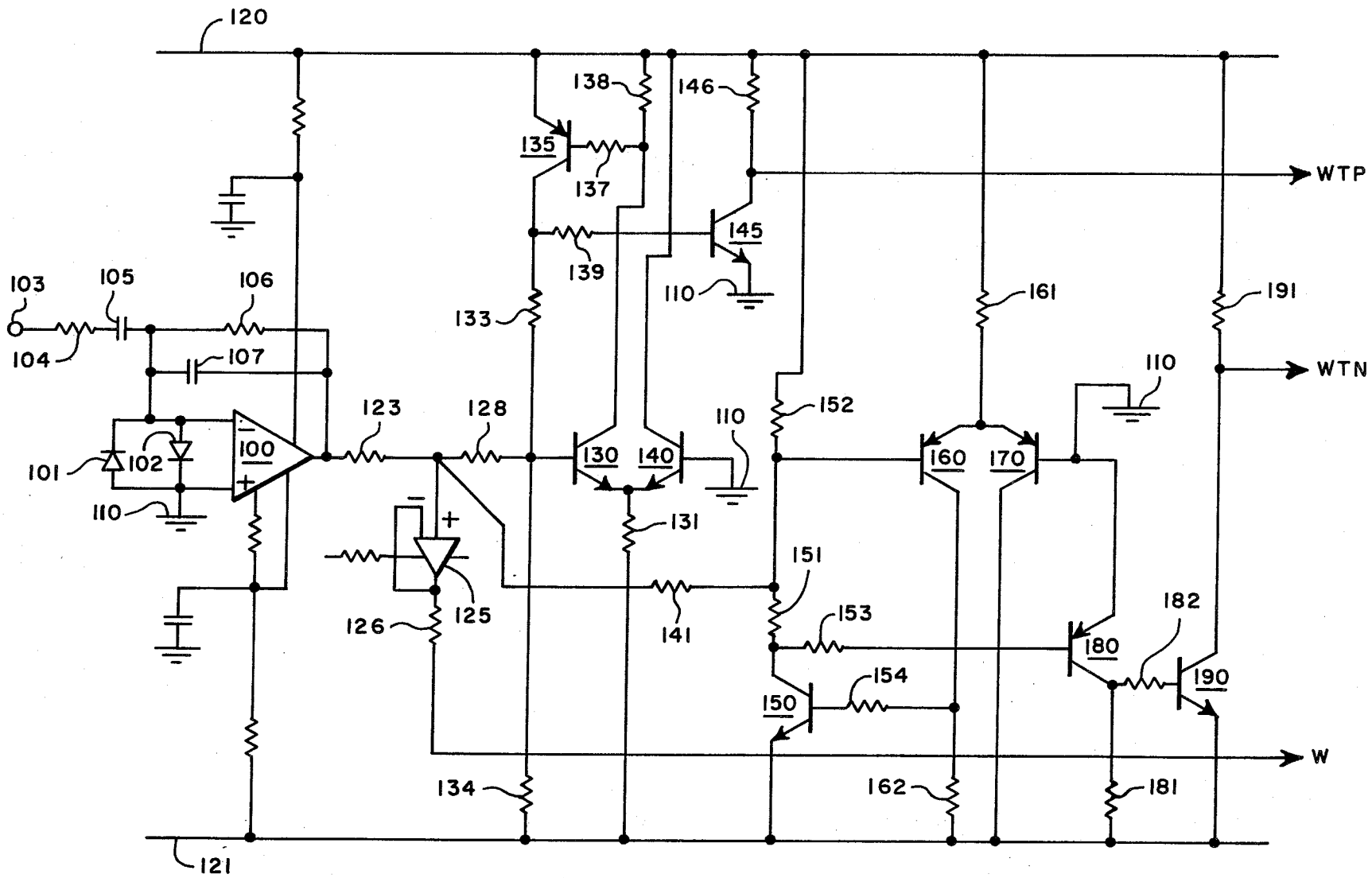
FIG. 4 is a schematic diagram of the slope detector and the positive and the negative threshold detectors used in the preferred embodiment of FIG. 2.

Analog signal processor 20 has two identical channels 21 and 22, as shown in FIG. 2. Each of the two channels has an input network 23 whose function it is to provide a degree of protection from very large transducer signals and to provide a first order rejection of high frequency interferring signals. The signal from input network 23 is amplified in a high gain amplifier 24, increasing the signal to a more useable level. A low pass filter 25 is provided to reject high frequency in the signal at the output of amplifier 24 and to produce a 6db/oct roll-off across the useable pass band, thereby generating an output signal directly proportional to the input magnetic disturbance. A high gain amplifier 26 is provided to further increase the signal to the desired level and is connected to apply the resulting signal to the input of a slope detector 27. Slope detector 27 will produce a bi-polar output signal in response to a minor disturbance in a uni-polar input signal. The slope detector is essentially a differentiator, generating a derivative of the analog input. FIGS. 4 and 6, together with the explanation which follows below, will be helpful to the understanding of its construction and the operation.

The signal from the output of slope detector 27 is applied to a pair of complementary threshold detectors 28 and 29 to generate digital output signals when the input signals exceed a predetermined threshold level. Threshold detector 28 provides an output signal whenever the signal at the output of slope detector 27 exceeds a predetermined positive value and threshold detector 29 provides a signal whenever the signal at the output of slope detector 27 exceeds a predetermined negative value.

FIG. 4 illustrates in schematic form the construction of slope detector 27 and positive and negative threshold detectors 28 and 29 of the analog signal processing channels in FIG. 2. Terminal 103 represents the input of slope detector 27, at which input is received the signal from amplifier 26 (FIG. 2). Terminal 103 is connected, through a series path of a resistor 104 and a capacitor 105, to the negative input of an operational amplifier 100. The positive input of operational amplifier 100 is connected to a ground 110 and, through a pair of diodes 101 and 102, to the negative input of amplifier 100. Diode 101 is oriented for forward current flow from the positive input to the negative input and diode 102 is oriented for positive current flow from the negative input to the positive input of amplifier 100. The voltage supply for amplifier 100 is obtained from a positive voltage reference 120 and the negative voltage reference 121. Operational amplifier 100, with its associated circuitry, comprises the slope detector, represented by block 27 in the analog signal processing channels of FIG. 2.

The output of amplifier 100 is connected to the base of an NPN transistor 130, through a series path of resistors 123 and 128. Transistor 130 has its emitter connected directly to the emitter of an NPN transistor 140, whose base is connected to ground 110, which is essentially at zero potential. The emitters of transistors 130 and 140 are further connected to the negative voltage reference 121 by means of a resistor 131, while the collector of transistor 130 is connected to the positive voltage reference 120 through a resistor 138, and the collector of transistor 140 is connected directly to the positive voltage reference 120. The base of transistor 130 is connected to the negative voltage reference 121 through a resistor 134 and to the positive voltage reference 120 through a series path provided by a resistor 133 and a PNP transistor 135. Transistor 135 has its emitter connected directly to the positive voltage reference 120, has its collector connected to the base of transistor 130 through resistor 133 and to the base of an NPN transistor 145 through a resistor 139, and has its base connected to the collector of transistor 130 through a resistor 137. Transistor 145 has its emitter connected directly to ground terminal 110 and has its collector connected to positive voltage reference 120 through a resistor 146 and directly to an output WTP. Transistors 130, 135, 140, and 145, together with the associated circuitry, comprise a positive threshold detector, as represented by block 28 in the analog signal processing channels of FIG. 2.

The schematic diagram detail of the negative threshold detector (block 29 of FIG. 2) is illustrated at the right hand portion of FIG. 4. It is comprised of transistors 150, 160, 170, 180, and 190, together with the associated circuitry. The output of operational amplifier 100 is connected to the base of PNP transistor 160, through a series path provided by resistors 123 and 141. The emitter of transistor 160 is connected directly to the emitter of PNP transistor 170, whose base is connected to ground terminal 110. The two emitters of transistors 160 and 170 are also connected to positive voltage reference 120 through a resistor 161, while the collector of transistor 170 is connected directly to the negative voltage reference 121 and the collector of transistor 160 is connected to the negative voltage reference 121 through a resistor 162. The base of transistor 160 is connected to positive voltage reference 120 through a resistor 152 and to the negative voltage reference 121 through a series path provided by a resistor 151 and an NPN transistor 150. Transistor 150 has its emitter connected directly to negative voltage reference 121 and has its base connected to the collector of transistor 160 through a resistor 154. The collector of transistor 150 is connected to the base of a PNP transistor 180 by means of a resistor 153. Transistor 180 has its collector connected to ground terminal 110, and has its collector connected to positive voltage reference 121 through a resistor 181 and to the base of an NPN transistor 190 through a resistor 182. The emitter of transistor 190 is connected directly to negative voltage reference 121, while its collector is connected to the positive voltage reference through a resistor 191 and also directly to an output WTN.

The slope detector output is also provided directly from operational amplifier 100, through a path provided by resistor 123, a buffer amplifier 125, and a resistor 126, at an output W. Signals WTP and WTN are normally high, i.e. they are close to the positive reference voltage. When the signal from operational amplifier 100 exceeds a predetermined positive voltage level, transistor 130 is caused to conduct, in turn causing transistor 135 to conduct. The conduction of transistor 135 results in a positive voltage at the base of transistor 145, turning it on and thereby dropping the voltage at the collector of transistor 145 and at output WTP essentially to zero. Therefore, a signal from the output of the slope detector exceeding a positive threshold will cause the normally high output at WTP to drop to a low.

In a similar fashion, the negative threshold detector results in the appearance of a low signal at the normally high output WTN whenever the signal from the output of the slope detector crosses beyond a predetermined threshold in the negative direction.

When viewing the relative position of the two sensors along a horizontal line normal to the direction of the road, one of the transducers is positioned to the left side and the other transducer is positioned to the right side of said horizontal line. For convenience of discussion, the transducer on the left side will be hereafter referred to as the left transducer, identified by numeral 11 in FIG. 1, and the transducer on the right side will be referred to as the right transducer, identified by numeral 10 in FIG. 1. The signal from the right transducer 10 is applied to the input of right channel 21 and the signal from the left trandsducer 11 is applied to the input of left channel 22. Channels 21 and 22 each have three outputs as follows: the signal from slope detector 27, the signal from positive threshold detector 28 and the signal from negative threshold detector 29. These signals are identified in FIGS. 1 and 2 as RW, RWTP, and RWTN for right channel 21 and LW, LWTP and LWTN for left channel 22. These six signals are processed by the digital signal processor logic shown in FIG. 3, to extract the information concerning the number and the direction of vehicle traffic along the road.

Signals LWTP, RWTP, RWTN and LWTN are applied to inputs of a simultaneous uni-polar threshold detect and latch circuit 41. The function of circuit 41 is to determine when the signals from slope detectors 27 of channels 21 and 22 simultaneously exceed the positive or the negative thresholds. When simultaneous positive or negative threshold signals are generated, circuit 41 provides an ENABLE signal to the input of a cross-coupled first event latching network 42, which further has a pair of SET inputs A and B.

Signal LW from the analog signal processor of FIG. 2 is applied to the input of a zero-crossing detector 44 and signal RW is applied to the input of a zero-crossing detector 45. The outputs of zero-crossing detectors 44 and 45 are applied, respectively, to SET inputs A and B of cross-coupled first event latching network 42. A clock 46 provides a train of uniform pulses to system control timer 43 and a sampling "D" flip-flop 53. Clock 46 has an input at which it receives start and stop signals from system control timer 43, which in turn is initiated by the output of a threshold detector 51, to be described later. System control timer 43 is designed to reset itself after and 8-second absence of a signal at its input.

After the cross-coupled first event latching network 42 is enabled by the simultaneous threshold occurrences detected by circuit 41, it will be set by the first signal received from the two zero-crossing detector circuits. The output of latching network 42 will determine the direction of the vehicle producing the analog disturbance in question. FIG. 6 illustrates actual signals obtained from wrinkle detectors 27 in response to two vehicles traveling in the right to left direction. The first zero-crossing to occur at either of the zero-crossing detector circuits 40 and 45, after simultaneous positive or negative threshold occurrences, will identify the direction of the vehicle travel.

Figure 5:
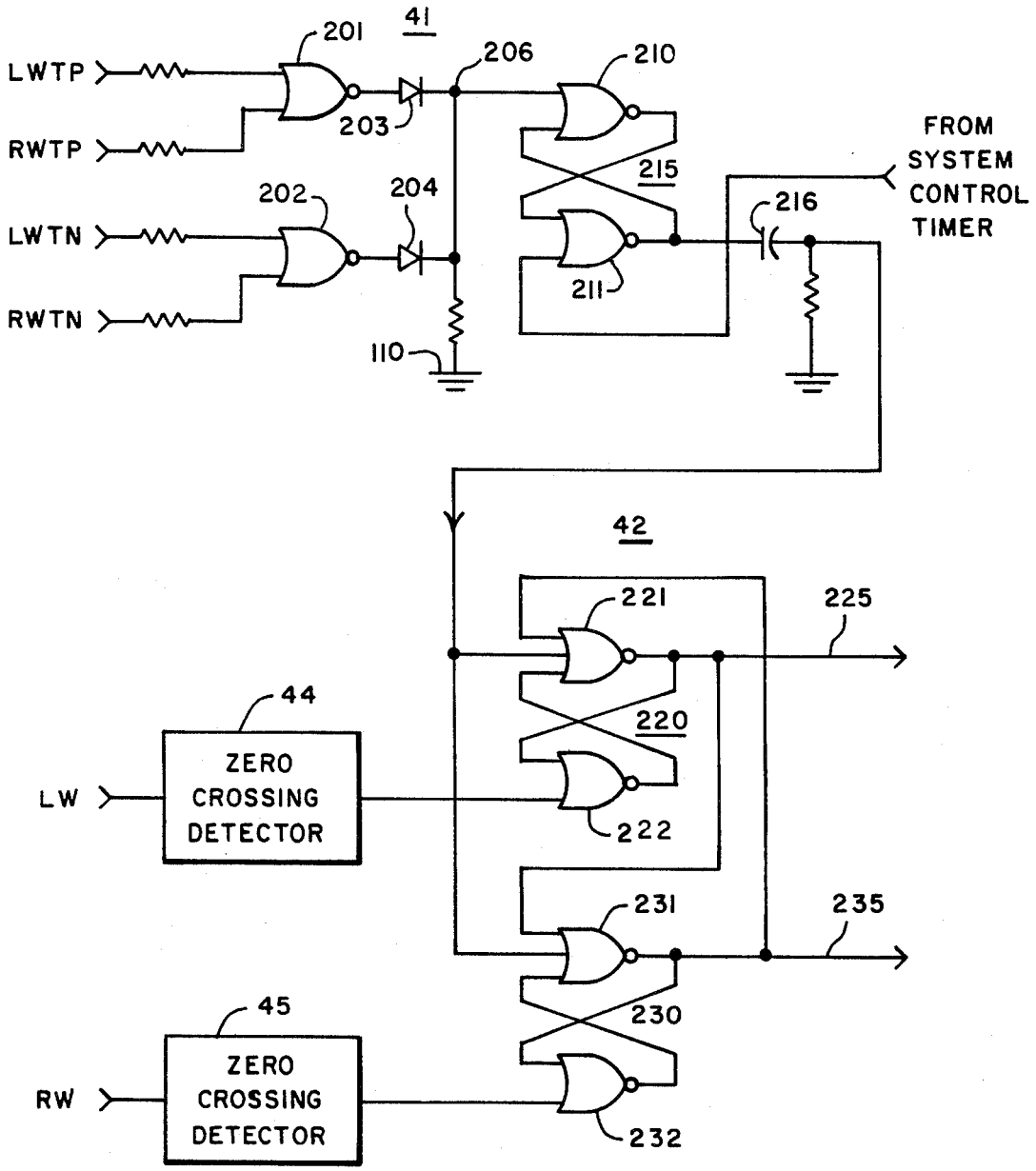
FIG. 5 is a schematic diagram of the simultaneous uni-polar threshold detect and latch circuit and cross-coupled first event latching network used in the digital signal processor logic of FIG. 3.

The simultaneous uni-polar threshold detect and latch circuit 41 and cross-coupled first event latching network 42 are shown in greater detail in FIG. 5. A pair of NOR gates 201 and 202 are shown, each having first and second inputs. Signals LWTP and RWTP from the positive threshold detectors of analog channels 21 and 22 are applied to the first and second inputs of NOR gate 201, respectively, and signals LWTN and RWTN from the negative threshold detectors are applied to the first and second inputs of NOR gate 202, respectively. The inputs of NOR gates 201 and 202 are normally high, while the output is normally low. A high output signal will be generated only when low signals appear at both inputs of either NOR gate 201 or 202. Diodes 203 and 204, respectively, connect the outputs of NOR gates 201 and 202 to a junction point 206, which is in turn connected to the input of a NOR gate 210. Diodes 203 and 204 comprise an OR gate, providing a signal to the input of a NOR gate 210 whenever a signal appears at the output of either NOR gate 201 or 202.

NOR gate 210, together with a NOR gate 211 form a latch 215 of a type well known in the art. An input of NOR gate 211 is adapted to receive a signal from system control timer 43 (FIG. 3) to reset the latch upon completion of the signal processing after passing of a magnetic disturbance. The output of latch 215 appears at the output of NOR gate 211 and is applied through a capacitor 216 to set inputs of cross-coupled first event latching network 42. Cross-coupled first event latching network 42 is comprised of two identical latches 220 and 230 each including a pair of NOR gates interconnected to form a latch in a manner well known in the art. Latch 220 is comprised of a NOR gate 221 having first, second, and third inputs and a NOR gate 222 having first and second inputs. The outputs of NOR gates 221 and 222 are connected respectively to the first inputs of the other NOR gate. Similarly, latch 230 is comprised of a NOR gate 231 having first, second, and third inputs and a NOR gate 232 having first and second inputs. The outputs of NOR gates 231 and 232 are connected respectively to the first input of the other NOR gate.

The second inputs of NOR gates 221 and 231 are connected to receive an ENABLE signal from the output of latch 215 in the simultaneous uni-polar threshold detect and latch circuit 41. The second inputs of NOR gates 222 and 232 are connected to receive signals from the output of zero crossing detectors 44 and 45, respectively. The third input of NOR gate 221 is connected to the output of NOR gate 231, while the third input of NOR gate 231 is connected to the output of NOR gate 221. Output signals are provided by latching network 42 at terminals 225 and 235. Terminal means 225 is connected to the output of NOR gate 221 and terminal 235 is connected to the output of NOR gate 231. Signals appearing at output terminals 225 and 235 are applied to the input of AND gate 56 shown in FIG. 3.

Depending upon which zero-crossing detector 44 or 45 produces first output signal, latching network 42 will generate a signal at terminal 225 or 235. Latching network 42 will then remain in that condition until the processing of the signal caused by a particular disturbance or series of disturbances stops. The condition of latching network 42 will identify the direction of the vehicle travel.

Figure 3:
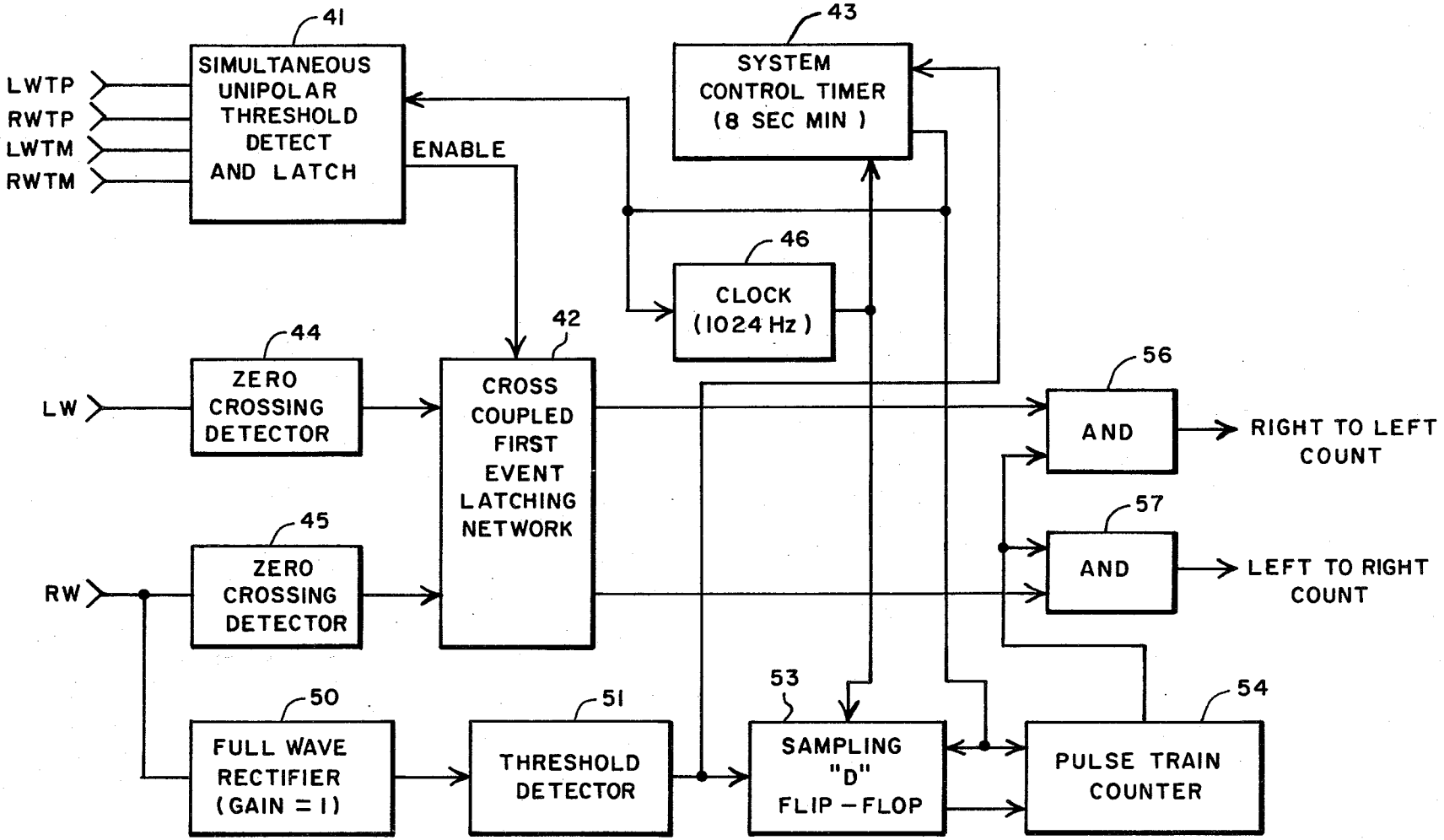
FIG. 3 is a block diagram of a digital signal processor logic used in the preferred embodiment of the present invention.

The counting of the vehicles traveling through the detection area is done by the circuitry shown at the bottom of FIG. 3. Signal RW is rectified in a full-wave rectifier 50 and is directed through a threshold detector 51, which in the preferred embodiment establishes a threshold level of 700 millivolts. If the signals exceeds the threshold level, it is applied to the input of a sampling "D" flip-flop 53 which functions to provide at its output a digital pulse train of varied pulse widths synchronized with clock 46. (Sampling "D" flip-flop is a generally available commercial component of the type described at pages 70 through 75 of "RCA COS/MOS Integrated Circuits", SSD-203C, 1975 DATABOOK Series.) The duration of and the separation between the pulses in the pulse train provide the information which enable the logic circuit to determine the number of vehicles moving within the range of transducers 10 and 11 within a given time period. FIGS. 7A and 7B illustrate the signals at the input and output, rspectively, of threshold detector 51. In generating a count of the vehicles, the following criteria are used:

If $T_1 > 1.5$ seconds, disregard pulse #1 and reset.

If $T_1 \leqq 1.5$ seconds, continue processing.

If $T_2 > 0.9$ seconds, produce an output count, reset and start over.

If $T_2 \leqq 0.9$ seconds, then produce the output count at time $t_6$, reset and start over.

If $T_3 > 0.9$ seconds, then logic operates as previously explained and as if one is starting at time $t_1$ again.

If $T_3 \leqq 0.9$ seconds, then logic will count all successive pulses in pairs only (not threes) provided Tx is continually $\leqq 0.9$ seconds.

If Tx is ever $> 0.9$ seconds, then start over. Any remaining single pulse is rejected.

This criteria is based on pulse spacing results from experimental data with different speeds, sizes, and single versus convoys of vehicles.

The output of pulse train counter 54 is applied to the inputs of AND gates 56 and 57, which also receive at its inputs the signals from cross-coupled first event latching network 42. The output of AND gate 56 provides a count of vehicles traveling from the right to the left and the output of AND gate 57 provides a count of the vehicles traveling from the left to the right.

Figure 8:
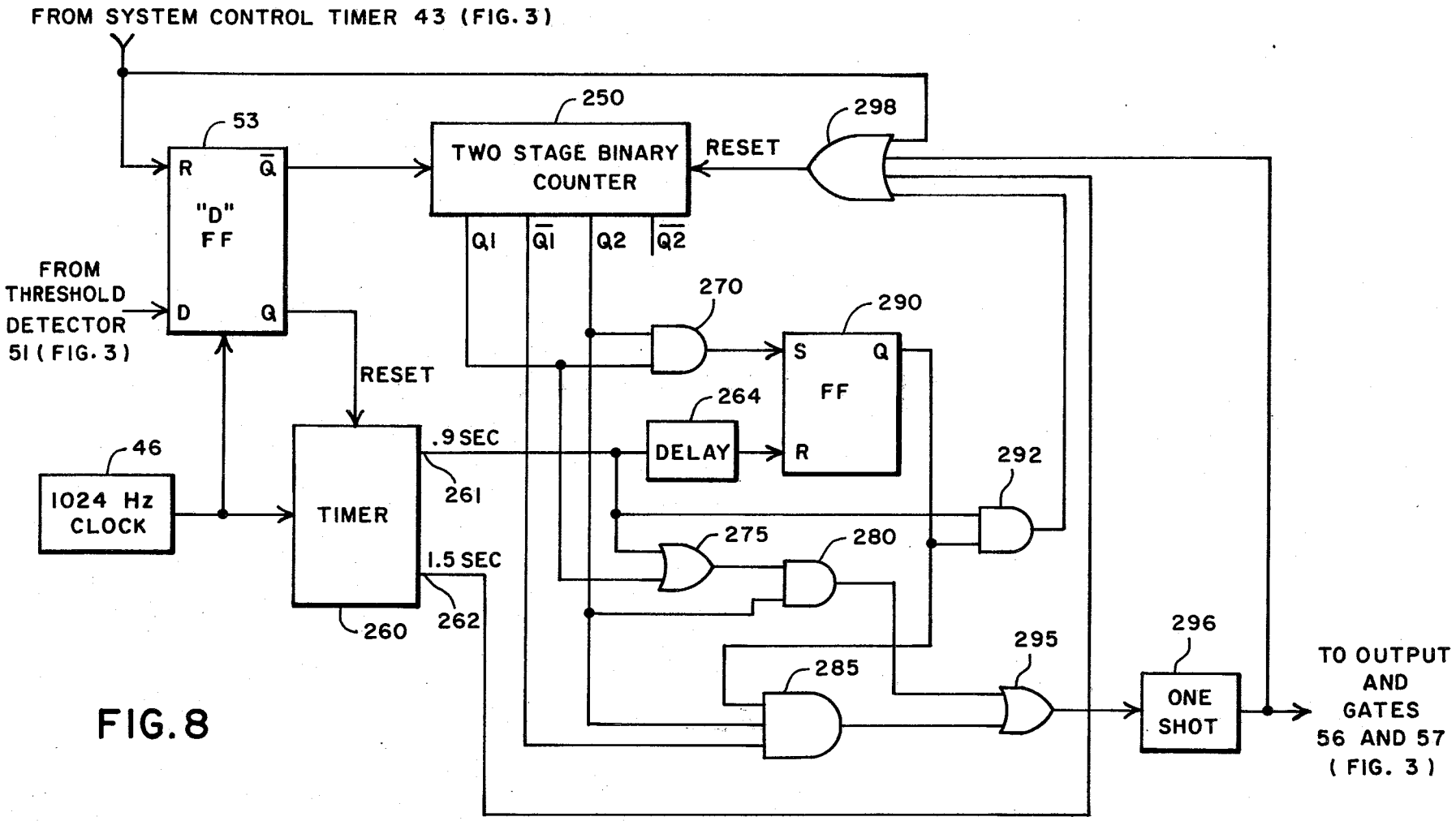
FIG. 8 illustrates a vehicle counting logic for use in the preferred embodiment of FIG. 3.

FIG. 8 illustrates in greater detail the construction of pulse train counting logic represented by pulse train counter 54 in FIG. 23. The normally high output Q of sampling "D" flip-flop 53 is connected to the input of a two-stage binary counter 250. Counter 250 has a pair of complementary first stage outputs Q1 and Q1 and a pair of complementary second stage outputs Q2 and Q2, and further has a reset input. A timer 260 is provided with two outputs 261 and 262. Timer 260 is enabled by the signal from the normally low output Q of sampling "D" flip-flop 53 and further receives clock pulses from clock 46. 0.9 seconds after the timer 260 is enabled, an output pulse is generated at its output 261 and 1.5 seconds after timer 260 is enabled, a pulse is generated at its output 262, unless the timer is reset prior to such times by the signal from flip-flop 53. Timer 260 is enabled by a low signal at the output Q of flip-flop 53 and is reset and disabled when the signal at output Q of flip-flop 53 is high.

Output Q1 of two-stage binary counter 250 is applied to one input of an AND gate 270 and to one input of an OR gate 275. AND gate 270 has a second input connected to output Q2 of counter 250 and OR gate 275 has a second input connected to output 261 of timer 260. Output Q1 of counter 250 is connected to the first of three inputs of an AND gate 285. The second input of AND gate 285 is connected directly to output Q2 of counter 250. A flip-flop 290 is provided, having a SET input connected to the output of AND gate 270, a RESET input connected to output 261 of timer 260, through a short delay 264, and an output Q connected to the third input of AND gate 285 and to the first of two inputs of an AND gate 292. The second input of AND gate 292 is connected to output 261 of timer 260. An OR gate 295 has a first input connected to the output of AND gate 280 and a second input connected to the output of AND gate 285, and has its output connected to the input of a one-shot 296, which produces a uniform pulse at its output in response to signals from OR gate 295. The output from one-shot 296 is then applied to inputs of AND gates 56 and 57 in the logic of FIG. 3 to provide a count of vehicle travel associated with the appropriate direction.

An OR gate 298 is provided with four inputs at which it receives signals from output 262 of timer 260, the output of AND gate 292, the output of one-shot 296, and from system control timer 43 (see FIG. 3), respectively. The output of OR gate 298 is connected to the RESET input of two-stage binary counter 250.

As will be readily evident to those skilled in the art, the pulse train counting logic operates to evaluate the signals received from sampling "D" flip-flop 53 in accordance with the criteria specified above.

A specific preferred embodiment of the invention was illustrated and described in this specification. It is understood, however, that many design variations are possible within the spirit of the invention and are intended to come within the scope of the appended claims.

I claim:

1. An apparatus for detecting the direction and the number of vehicles passing by a predetermined point along a vehicle path, said apparatus comprising:

first and second magnetic sensors positioned in a spaced relationship, the first of said sensors being oriented for maximum sensitivity ot magnetic disturbance at a first point on said vehicle path and the second of said sensors being oriented for maximum sensitivity to magnetic disturbance at a second point on said vehicle path;

first and second analog signal processing channels connected to receive output signals from first and second magnetic sensors, respectively, each of said channels including, differentiating means for providing a signal which is a derivative of the signal from the magnetic sensor, and a zero-crossing detector connected to receive the signal from said differentiating means, said zero-crossing detector providing an output pulse each time the signal from said differentiating means crosses a zero reference level;

direction determining logic means for receiving signals from the zero-crossing detectors of said first and second channels and for providing at its output a signal indicative of the direction of the vehicle travel along said path depending upon which of said zero-crossing detectors produces the first output signal, and;

vehicle counting logic means for receiving the signal from the differentiating means of said first channel and providing an output indicative of the number of vehicles passing along said vehicle path past said predetermined point.

2. Apparatus according to claim 1, wherein said vehicle counting logic means includes, a full wave rectifier for receiving and rectifying the signal from the differentiating means of said first channel, a threshold detector for receiving the rectified signal from said full-wave rectifier and for providing at its output a signal which is a square wave defined by the crossings of the signal from said full-wave rectifier over a predetermined threshold voltage level, and a timing and counting logic providing an output indicative of the number of vehicles passing past a predetermined point along said vehicle path, said output being generated as a function of the number of and the time separation between the pulses appearing at the output of said threshold detector.

3. Apparatus according to claim 2, wherein said timing and counting logic includes means for measuring time separation between successive pulses appearing at the output of said threshold detector, using the following criteria:

if the separation between the first and second pulses exceeds A, the first pulse is disregarded and the timing and counting logic is reset, if the separation between the first and second pulses is less than or equal to A and the separation between the second and third pulses exceeds B, a count is produced indicating the presence of one vehicle, if the time separation between the second and the third pulses is less than or equal to B, than a count is produced indicating the presence of a vehicle, if the separation between the third and fourth pulses exceeds B, then the timing and counting logic is reset, if the time separation between the third and the fourth pulses is less than or equal to B, then all successive pulses, so long as such pulses are not separated by more than B, will be counted in pairs, each pair indicating the presence of one vehicle, if the time separation between any two pulses exceeds B, the timing and counting logic is reset to the initial state and any remaining single pulse is rejected, where A represents a first longer time period and B represents a second shorter time period.

4. Apparatus according to claim 3, wherein A is 1.5 seconds and B is 0.9 seconds.

5. Apparatus according to claim 1, wherein said first and second signal processing channels each include a positive threshold detecting means for generating a signal whenever the signal from said differentiating means exceeds a positive threshold and a negative threshold detecting means for providing a signal whenever the signal from said differentiating means exceeds a negative threshold; and said direction determining logic includes means for receiving signals from said positive and negative threshold detecting means of said first and second channels, as well as the signals from said zero-crossing detectors, for providing at its output a signal indicative of the direction of vehicle travel along said path depending upon which of said zero-crossing detectors provduces the first output signal after the signals from said differentiating means of each of said two channels simultaneously exceed said positive threshold or simultaneously exceed said negative threshold.

6. Apparatus according to claim 5, wherein said vehicle counting logic means includes, a full wave rectifier for receiving and rectifying the signal from the differentiating means of said first channel, a threshold detector for receiving the rectified signal from said full-wave rectifier and for providing at its output a signal which is a square wave defined by the crossings of the signal from said full-wave rectifier over a predetermined threshold voltage level, and a timing and counting logic providing an output indicative of the number of vehicles passing past a predetermined point along said vehicle path, said output being generated as a function of the number of and the time separation between the pulses appearing at the output of said threshold detector.

7. Apparatus according to claim 6, wherein said timing and counting logic includes means for measuring time separation between successive pulses appearing at the output of said threshold detector, using the following criteria:

if the separation between the first and second pulses exceeds A, the first pulse is disregarded and the timing and counting logic is reset, if the separation between the first and second pulses is less than or equal to A and the separation between the second and third pulses exceeds B, a count is produced indicating the presence of one vehicle, if the time separation between the second and the third pulses is less than or equal to B, then a count is produced indicating the presence of a vehicle, if the separation between the third and fourth pulses exceeds B, then the timing and counting logic is reset, if the time separation between the third and the fourth pulses is less than or equal to B, then all successive pulses, so long as such pulses are not separated by more than B, will be counted in pairs, each pair indicating the presence of one vehicle, if the time separation between any two pulses exceeds B, the timing and counting logic is reset to the initial state and any remaining single pulse is rejected, where A represents a first longer time period and B represents a second shorter time period.

8. Apparatus according to claim 7, wherein A is 1.5 seconds and B is 0.9 seconds.

* * * * *